US006588688B1

(12) United States Patent
Rössler

(10) Patent No.: US 6,588,688 B1
(45) Date of Patent: Jul. 8, 2003

(54) GRINDER FOR COMMINUTING WASTE MATERIAL

(75) Inventor: Peter Rössler, Ilsfeld (DE)

(73) Assignee: Weima Maschinenbau GmbH (DE)

( * ) Notice: Subject to any disclaimer, the term of this patent is extended or adjusted under 35 U.S.C. 154(b) by 0 days.

(21) Appl. No.: 09/631,313

(22) Filed: Aug. 3, 2000

(51) Int. Cl.[7] ..... B02C 18/22
(52) U.S. Cl. ..... 241/35; 241/223
(58) Field of Search ..... 241/35, 186, 242, 241/243, 223, 34

(56) References Cited

U.S. PATENT DOCUMENTS 2,150,984 A * 3/1939 Near et al. ..... 241/223
2,561,069 A * 7/1951 Peterson ..... 241/223
4,632,318 A * 12/1986 Hyuga ..... 241/223
4,927,088 A * 5/1990 Brewer ..... 241/223
5,639,032 A * 6/1997 Roessler ..... 241/223

* cited by examiner

*Primary Examiner*—Mark Rosenbaum
(74) *Attorney, Agent, or Firm*—Factor & Partners

(57) ABSTRACT

A grinder for comminuting waste material comprises a frame structure (18, 20). A grinding rotor (24) is rotatably carried by the frame structure (18, 20.) The grinding rotor (24) carries a plurality of cutting tools (36) cooperating with a counter blade (26, 28) carried by the frame structure (18, 20). Two plate chain conveyors (68, 70) are vertically aligned so that working runs (80, 120) thereof form a converging moving wall funnel positively feeding pieces (146, 148) of material to be comminuted towards a grinding unit (12) formed by the grinding rotor (24) and the counter blade (26, 28).

23 Claims, 4 Drawing Sheets

GRINDER FOR COMMINUTING WASTE MATERIAL

The present invention relates to a grinder for comminuting waste material.

A known such grinder is shown in U.S. Pat. 5,639,032. This grinder comprises a grinding unit formed by a grinding rotor driven by an electric motor and by a counter blade carried by a machine frame. The waste material to be comminuted is urged to the rotor by means of a box shaped pushing element driven by a hydraulic jack so as to move across the bottom wall of a hopper containing the material to be comminuted.

Such known grinders are useful in connection with waste material of short dimension. However, these grinders are less suitable in connection with long wastes like laths or residual long portions of chip board material as obtained in factories for furniture and the like.

For grinding such elongate wastes there are known in the market grinders, which include two high friction serrated feed cylinders which are vertically aligned and are arranged in front of the grinding unit so as to positively feed the laths or the like towards the grinding rotor by firmly engaging the upper and lower surface thereof.

However, such grinders using a roller pair feed mechanism can grasp a single lath or the like at a given time, only. Also the contact area between the feeding rollers and the piece of waste material is small.

Thus it is an object of the present invention to provide a grinder having a waste material feed unit which can also feed a plurality of waste material pieces and which warrants a good frictional contact of the feed unit to the pieces of waste material.

To this end the invention proposes a grinder for comminuting waste material comprising a frame structure, comprising a grinding rotor journalled in the frame structure, which includes a plurality of cutting tools, comprising a counter blade carried by the frame structure and cooperating with the grinding rotor, and comprising feed means to positively feed waste material to the grinding rotor, wherein the feed means comprise a lower feed conveyor and an upper feed conveyor which are vertically aligned and each comprise an endless transport element running on two spaced return rollers, a lower work run of the upper conveyor and an upper work run of the lower conveyor thus forming a moving wall feeding passage for the waste material to be comminuted.

Further advantageous improvements of the invention relate to the following:

The endless transport element comprises a plate chain. In such a grinder the feed means are of particularly robust and solid construction.

The plate chain comprises plate chain members each having a plate portion and forward and rear hinge portions. This geometry of the single plate chain links is advantageous in view of a compact structure and in view of low production costs, since a separate driving chain is not necessary. The plate chain members can be easily connected by chain pins to form an endless belt like transport means.

Cooperating hinge portions of adjacent plate chain members form a hinge rib of constant cross section. In such a grinder the inward side of the transport means is formed with a plurality of transverse ribs, each of which are partly formed by a given plate chain member and a succeeding or preceeding adjacent plate chain member. The continuous transverse ribs thus at the same time form driving ribs cooperating with a driven return roller.

The plate chain member has a high friction surface. This further improvement is advantageous in view of good frictional contact between the two feed conveyors and the surfaces of the waste material pieces.

In view of obtaining the same advantage in a different way the invention further proposes a grinder, wherein the high friction surface comprises a rib structure, as well as a grinder, wherein the high friction surface comprises at least one spike, as well as a grinder, wherein the high friction surface comprises a rubber coating.

A still further improvement of the invention is a grinder, wherein the return rollers are provided with recesses cooperating with projections formed on the inward surface of the associated transport element. Thus the a driving return roller can transfer high forces to a transport element having matingly equidistant driving ribs on the inward face thereof.

In view of the same effect the invention further proposes a grinder, wherein the return rollers are of polygonal cross section.

A further improvement of the invention is a grinder, wherein the return rollers comprise spaced end plates and shaft rigidly connecting the end plates. This improvement is advantageous in obtaining return rollers of great axial dimension and yet small mass.

A further improvement of the invention relates to a grinder wherein at least one of the conveyors comprises a subframe movably carried by the frame structure. In such a grinder the conveyors can be at least partly adjusted in vertical direction. This allows the grinder to comminute waste materials of varying vertical dimension.

Furthermore a grinder is proposed, wherein the downstream return roller of one of the conveyors is carried by the movable subframe so as to be adjustable in vertical direction. This construction of the grinder allows vertical adjustment of the height of the effective transport gap defined by the two conveyors in a particularly simple way. The drive motors associated to the movable conveyor or the movable conveyors can be located at the upstream return roller, which is at the same time the pivot axis of the subframe. Thus the drive motor of the conveyor need not be moved when the vertical position of the downstream end of the conveyor is adjusted. This allows automatic adjustment of the movable conveyor by the incoming waste material pieces overcoming the weight of the subframe and the components carried thereby (downstream return roller plus transport element).

In a further embodiment the movable subframe is pivotable about the axis of the upstream return roller of the movable conveyor. In such a grinder no complicated guide means need to be provided for the downstream return roller of the movable conveyor.

The invention also considers a grinder, wherein the subframe cooperates with a vertically adjustable abutment member. In such a grinder the minimum width of the distance between the upper and lower conveyors is limited to an adjustable value. At the same time the movable conveyor is free to move in vertical direction when cooperating with waste material pieces of greater height.

The grinder may be provided with a support plate to supports the upper run of at least one of the conveyors. In such a grinder the upper runs of the respective conveyors are vertically supported and run at a predetermined height.

Furthermore a grinder is proposed, wherein at least part of the support plate is made from material cooperating with the associated transport element under low friction. In such a conveyor the lower sides of the transport elements can move across the associated support plate under small friction.

The invention further proposes a grinder, wherein pressure rollers act on the lower run of the upper conveyor, said pressure rollers being biassed by spring elements. This construction allows for increased engaging forces between the two conveyors and the waste material to be comminuted.

The invention furthermore proposes a grinder, wherein at least part of the spring elements comprise gas springs. In such a grinder the force exerted by the springs onto the transport element biassed thereby can be easily adjusted by varying the pressure in the gas spring.

The invention also proposes a grinder, wherein independent identical drive units are provided for the upper and lower conveyors. In such a grinder there is no need for a positive mechanical couppling between the two conveyors. Also the conveyors can run at somewhat different speed if such is required by the geometry of the arrangement of the two conveyors (upper conveyor parallel to the lower conveyor or inclined with respect to the lower conveyor) or by load requirements.

A grinder is preferred, wherein a load sensor cooperates with a motor driving the grinding rotor and wherein the drive units associated to the upper and lower conveyors are energized in accordance with the signal output from said load sensor. In such a conveyor the waste material feed means are automatically stopped when the grinding rotor needs too torque to comminute the waste material in its vicinity. The waste material transport means are automatically restarted, when the grinding rotor is ready to comminute further material.

Further improvements of the invention relate to the grinding rotor running at a speed of 120 to 240 rpm or preferably between 160 and 200 rpm. Operation of the grinding rotor at such rpms is particularly advantageous in connection with alongate waste material pieces consisting of wood, chip board and the like.

The invention will now be explained in more detail referring to the drawings. Therein FIG. 1 is a lengthwise vertical section through a grinder for comminuting elongate waste wood pieces;

Figure 1:
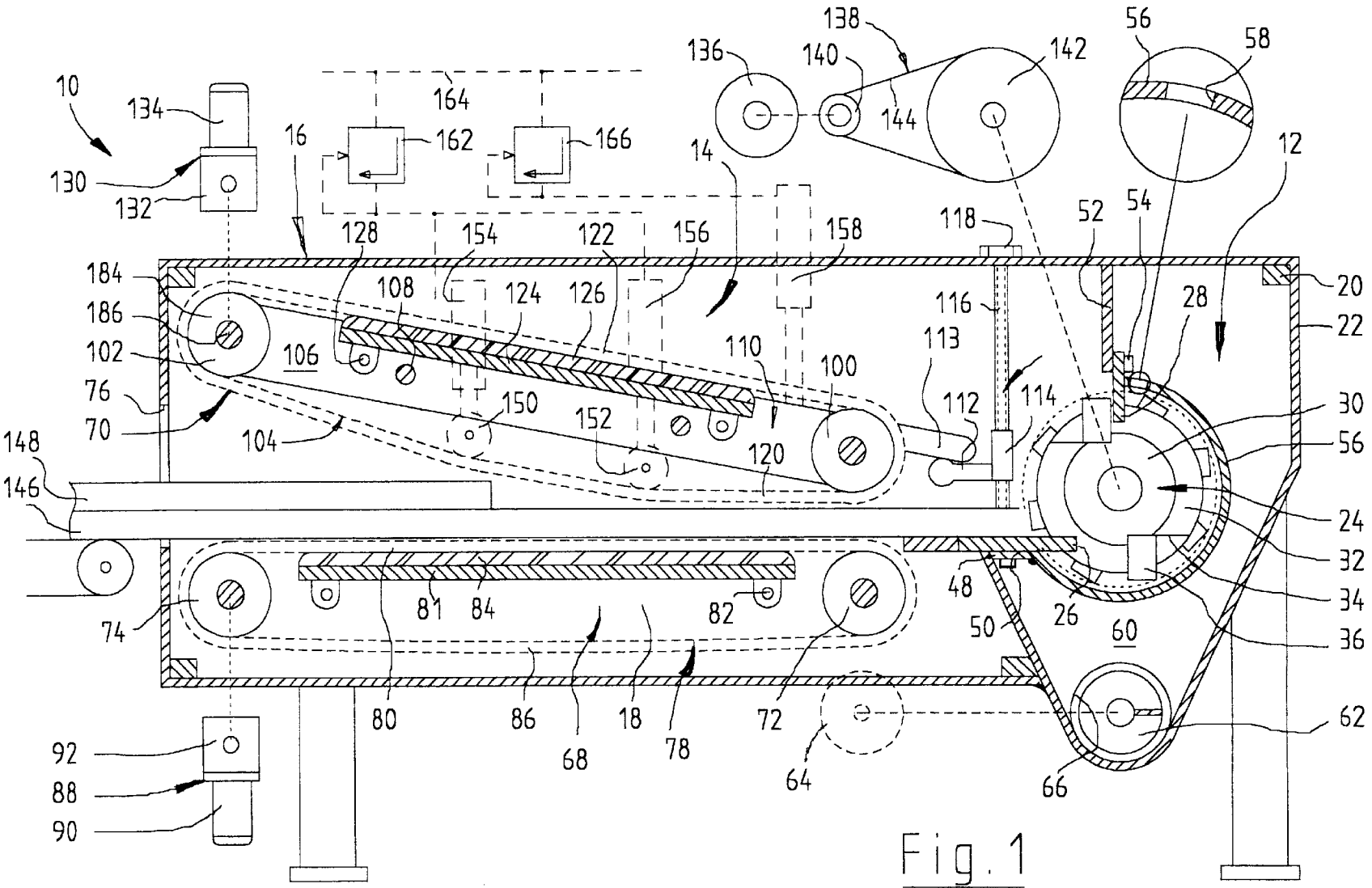

In FIG. 1 a grinder for comminuting elongate waste wood material is generally shown at 10. The grinder 10 has two main subunits, i.e. a grinding unit 12 and a waste material feeding unit 14. These two units are arranged in a housing 16 including robust thick side plates 18 interconnected by robust transverse frame members 20. The side plates 18 and the frame members 20 together form a rigid frame structure. The open sides of this frame structure are closed by sheet metal walls 22 fixed to the frame structure.

The grinding unit 12 comprises a grinding rotor 24 and two counter blades 26, 28 cooperating therewith.

The grinding rotor 24 includes a core member 30 having a plurality of axially succeeding circumferential ribs 32 of triangular (90° isosceles triangle) cross section. Part of the ribs 32 is milled away to form pockets 34 receiving cutting tools 36. The latter are of quadratic outline and are fixed in the pockets 34 by means of fixing screws 38 extending through a bore 40 of the cutting tool which is along a diagonal line of the cutting tool. The bore 40 is counterbored from either side to receive a head of the fixing screw 38. By this construction the cutting tool 36 can be mounted in a pocket 34 in four different positions, in each of which two of the eight cutting edges of the cutting tool 36 are active.

Figure 2:
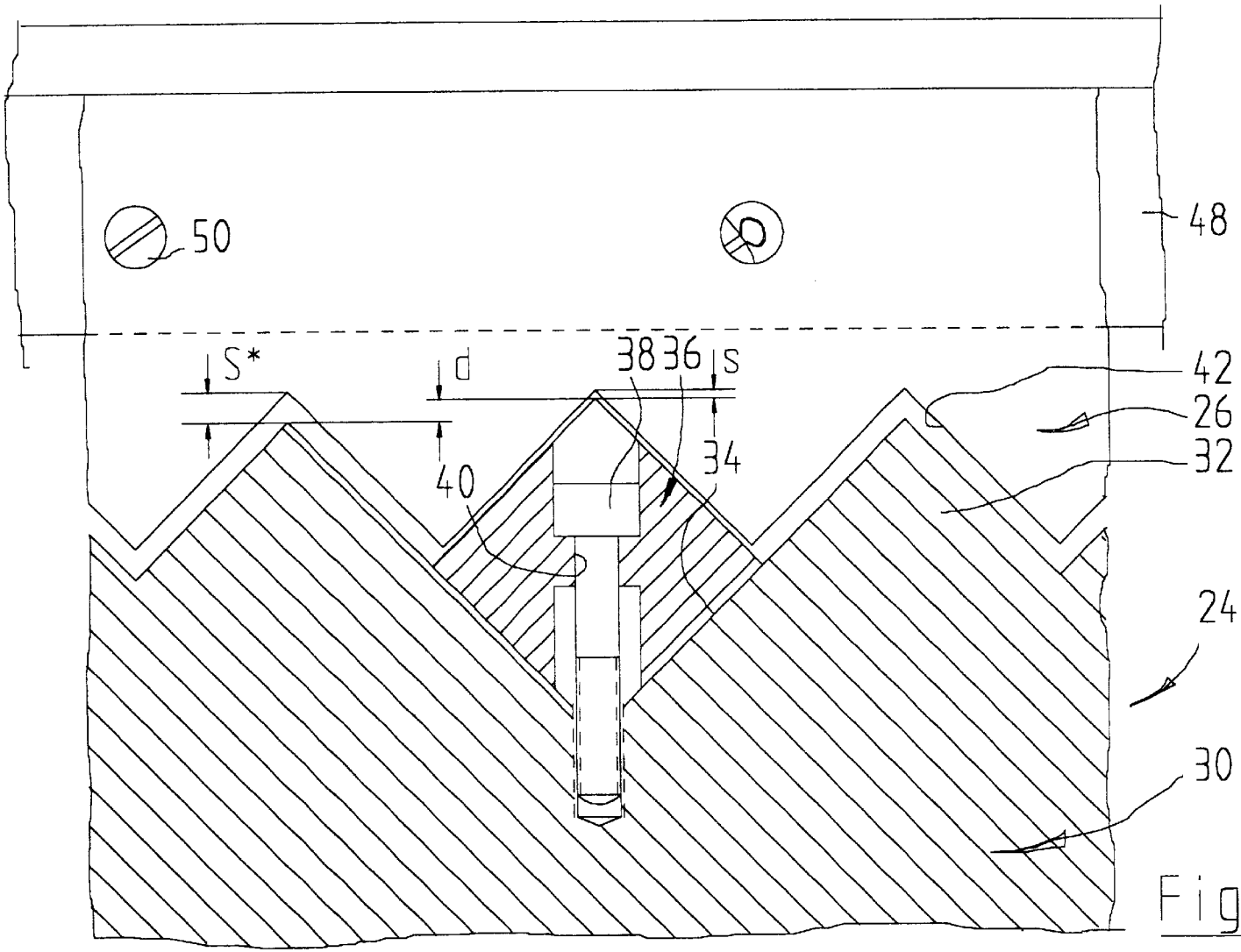
FIG. 2 is a plan view of part of the rotor of the grinder of FIG. 1 shown in axial section and part of a counter blade cooperating with the rotor to form a grinding nip.

As may best be seen from FIG. 2, the counter blade 26 (and 28) has a zig-zag cutting edge 42 following the contour of the core member 30 under a constant distance S*. The cutting tool 36 is slightly higher than the ribs 32 so that a cutting tool 36 forms a smaller cutting gap s together with the opposing portion of the cutting edge 42. The difference between S* and s is shown at d in FIG. 2.

As may also be seen from FIG. 2 the counter blade 26 is fixed to a blade carrier 48 connected to the side blades 18 by means of screws 50.

The geometry of the counter blade 28 corresponds to the one of counter blade 26 and need not be described again in detail. The counter blade 28 is fixed to a blade carrier 52 rigidly connected to the housing 16 by means of screws 54.

A part cylindrical sieve 56 surrounds the grinding rotor 24 extending from the counter blade 26 to the counter blade 28. The angular extension of the sieve 56 is about 280°. The sieve 56 is provided with openings 58 through which waste material cut into small particles or chips by cooperation of the grinding rotor 24 and the counter blade 26 (and to a lesser degree the counter blade 28) may pass and exit into a chip collecting chamber 60 formed in a lower portion of the housing 16. The chip collecting chamber 60 is separated from the remainder of the housing 16 by the counter blade 26, the blade carrier 48, the sieve 56 and the upper vertical counter blade 28 together with the blade carrier 52. Thus the blade carriers 48 and 52 also form walls of the chip collecting chamber 60.

In the lower most trough shaped portion of the chip collecting chamber 60 a feed screw 62 is provided, which is driven by a motor 64 shown in dashed line, since in reality this motor is arranged above the drawing plane on the outer side of the respective side plate 18. By rotation of the feed screw 62 the chips having accumulated in the chip collecting chamber 60 are fed to a chip outlet opening 66 provided in the rear side plate 18. A chip feed pipe which is not shown in the drawings, is connected to the chip outlet opening 66 to feed comminuted waste material to a chip reservoir or a chip briquetting machine, both not shown in the drawings.

The waste material feeding unit 14 comprises as main subunits a lower conveyor 68 and an upper conveyor 70.

The lower conveyor 68 has a downstream return roller 72 being immediately adjacent to the plate carrier 48 and an upstream return roller 74 being adjacent to a waste entrance opening 76 formed in the left hand end wall of the housing 16. A chain like transport element 78 runs over the two return roller 72, 74, the ends of which are journalled in the side plates 18.

As may be seen from FIG. 1, an upper work run 80 of the lower conveyor 68 is supported by a support plate 81 extending throughout the transverse dimension of the housing 16 and being fixed to the side plates 18 by screws 82.

The support plate 81 carries a low friction lining 84 cooperating with the lower side of the work run 80. Thus the work run 80 is firmly supported in vertical direction while running across the support plate 81 under small friction.

Figure 5:
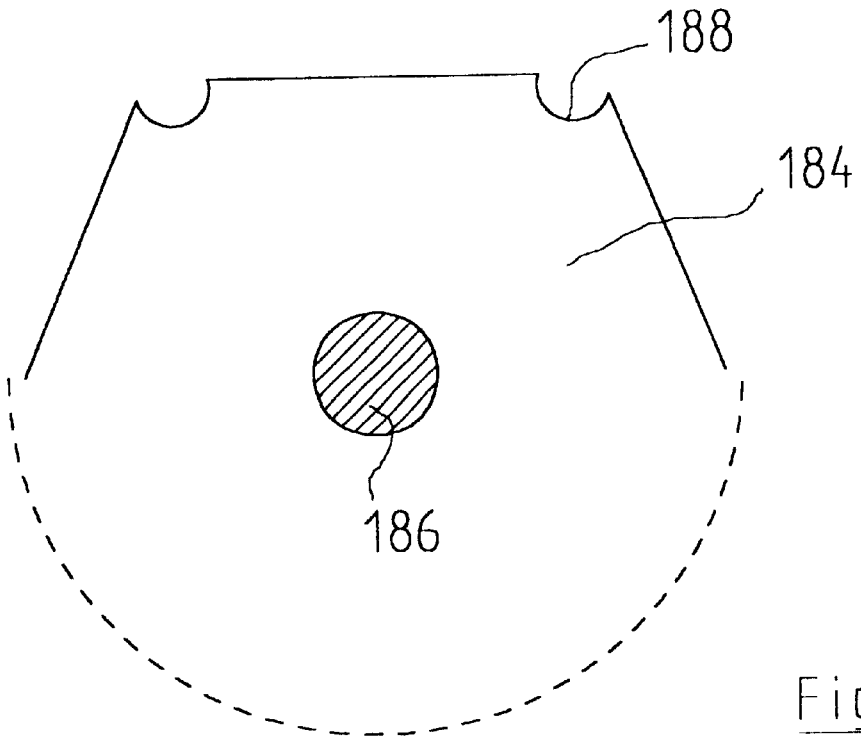
FIG. 5 is an axial view of an endplate of a return roller of a waste material conveyor shown in FIG. 1.

As may also be seen from FIG. 1, a lower return run 86 of the lower conveyor 68 is slack. There is positive engagement between the inner side of the transport element 78 and the return rollers 72, 74 as will be explained in more detail below referring to FIG. 5.

The upstream return roller 74 is driven by a drive unit 88 including an electric motor 90 and an angle reduction gear 98. The position of the drive unit 88 has been chosen in view of explanation purposes. In reality, the drive unit 88 is arranged on the outward side of the side plate 18.

Correspondingly, the upper conveyor 70 comprises a downstream return roller 100 and an upstream return roller 102 as well as a chain like transport element 104 running on these rollers.

The transport roller 104 is journalled in the side plates 18, while the downstream return roller 104 is journalled in longitudinal frame plates 106, which are interconnected by transverse rods 108 to form a rigid subframe 110. The left hand ends of the frame plates 106 are pivotally arranged on the end portions of the shaft of the return roller 102.

Thus the subframe 120 and the components carried thereby (return roller 100 and transport element 104) are biassed in clockwise direction by gravity.

A lowermost working position of the upper conveyor 70 can be adjusted by means of an abutment member 112 carried by a vertical threaded sleeve 114 carried by a vertical threaded spindle 116 journalled in the housing 16 and having an actuating head 118 arranged above the upper wall of the housing 16. Thus by turning a wrench cooperating with the actuating head 118 the lowermost operating position of the conveyor 70 can be adjusted.

A lower work run 120 of the transport element 104 is slack and extends along a chain or cable curve under the influence of its weight. An upper return run 122 of the transport element 104 is supported by a support plate 124 having a low friction lining 126 and being secured to the frame plate 106 by screws 128.

The upstream return roller 102 is driven by a drive unit 130 including an angle reduction gear 132 and an electric motor 134. The drive unit 130 is identical to the drive unit 88 and under same operating conditions will behave the same way.

The grinding rotor 24 is driven by a high power three phase electric motor 136 via a reduction gear 138 including two pullies 140, 142 of small and large diameter, respectively, and a belt 144. The motor 136 and the reduction gear 138 are shown above the housing 16 for explanation purposes. In reality they are carried by the outward side of the side plate 18.

The grinder described above operated as follows:

Elongate waste wood material like laths or chip board material are supplied to the entrance opening 76 of the housing 16 using appropriate known feed means, i.e. a belt conveyor as schematically shown at 144, a vibratory chute, a roller conveyor or the like. In FIG. 1 two elongate pieces 146, 148 of waste wood are shown being actually fed into the grinder 10. The pieces of waste material are put onto the belt conveyor 144 without paying attention to their size and position. So, layers of different numbers of elongate pieces arrive at the entrance opening 76. These layers are contacted by the upper conveyor 70 by an intermediate portion of its lower work run 120. The incoming upper piece 148 is shown in such position of first contact. Upon further forward feeding of the work piece 148 the latter will be grasped by the outer surface of the transport element 104. Upon still further forward feeding of the piece 148 the lower work run 120 of the upper conveyor 70 will deform overcoming gravity so as to provide an increasing contact surface between its work run 120 and the upper side of the piece 148. When the piece 148 approaches the downstream return roller 100 the latter will be elevated such that the combined layer of pieces 146 and 148 can pass between the downstream ends of the two conveyors 68, 70. In the end the two pieces 146, 148 are both fed to the grinding rotor 24 and will both be chipped by the latter.

Typically the distance between the two upstream return rollers 74 and 102 can be chosen to be about 300 mm, while the smallest gap defined between the two downstream ends of the work runs 80 and 120 can be established to be as small as 1 or 2 mm (in the case of comminuting thin plates or veneer material).

In view of increasing the pressure exerted by the work run 120 onto the pieces 146, 148 pressure rollers 150, 152 may be provided as indicated in dashed lines. These pressure rollers extend across the entire width of the transport element 104 and are rotatably carried by the piston rods of associated pneumatic jacks 154, 156 fixed to the side plates 18, respectively.

If desired, one may also provide further pneumatic jacks 158 fixed to the side plates 1B, the piston rods of which are pivotally connected to the free ends of the frame plates 106.

The force provided by the pneumatic jacks 154, 156 may be adjusted by setting a pressure regulator 162, by which the jacks 158, 160 are connected to a pressure air line 164. Analogously, the pressure jacks 158 are pressurized via a pressure regulator 166 also being connected to the pressure air line 164.

Figure 3:
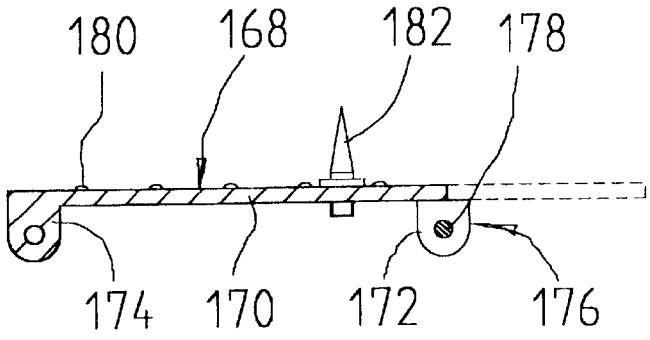
FIG. 3 is a longitudinal vertical section through a plate chain member of a conveyor of the grinder shown in FIG. 1, this section being along line III—III of FIG. 4.
Figure 4:
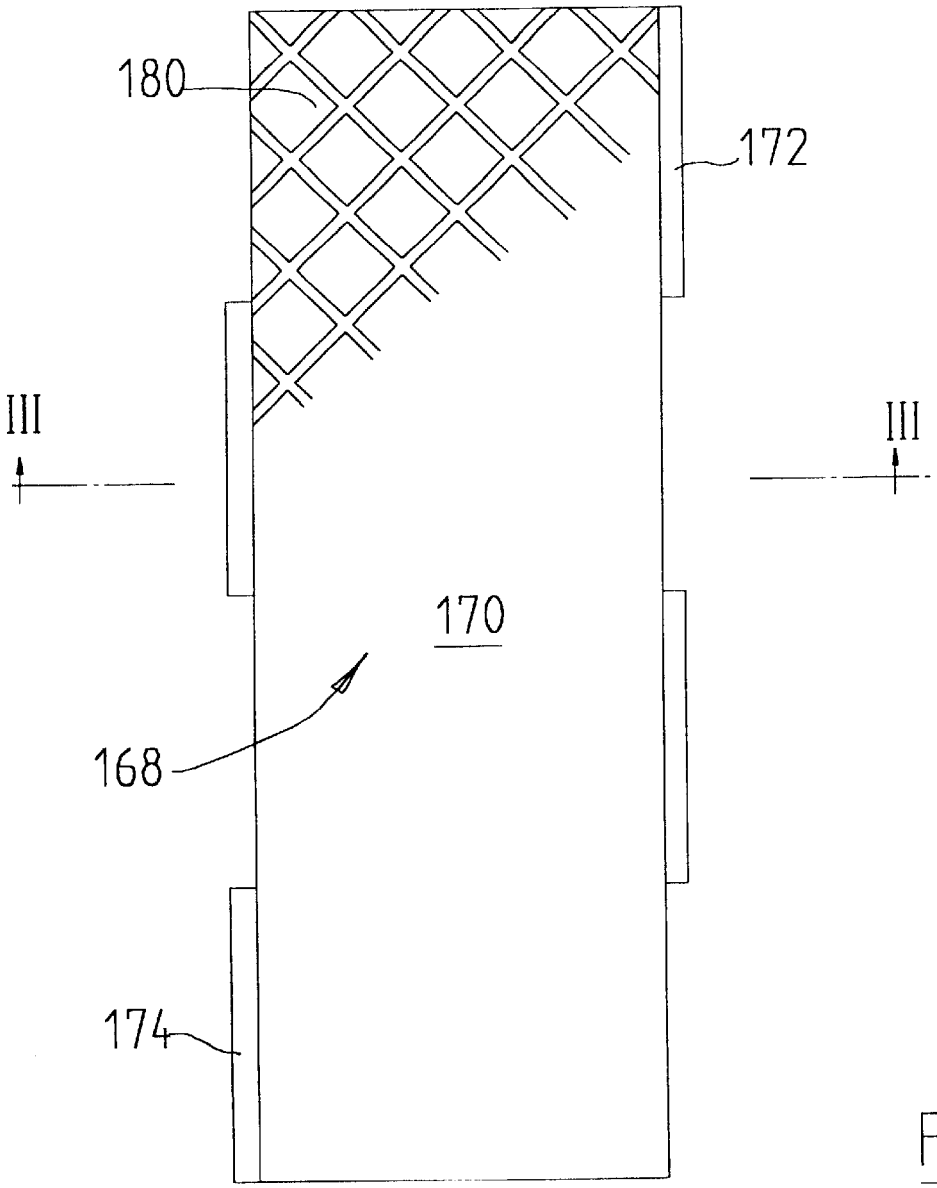
FIG. 4 is a plan view of the plate chain member of FIG. 3.

FIGS. 3 and 4 show details of plate chain members 168, from which the transport elements 78 and 104 are made. The plate chain members 168 comprise a plate portion 170 and forward hinge portions 172 and rear hinge portions 174 formed integral therewith. As may be seen from FIG. 4, the forward and rear hinge portions 172, 174 are staggered in transverse direction each extending about one quarter of the transversal extension of the plate portion 170. Thus the hinge portions 172, 174, which are of identical cross section, form one continuous hinge rib 176 once two adjacent plate chain members 168 have been connected by a long hinge pin 178.

In view of increasing the friction between the surface of the transport elements 78, 104 and the pieces of waste material to be comminuted, the outer surface of the plate portion 170 is provided with a rib structure 180 forming a quadratic lattice. The edges of the individual cells are inclined with respect to the longitudinal and transverse directions by an angle of 45°.

Alternatively or in addition the plate chain members 68 may be provided with outwardly facing spikes 182 which are screwed into corresponding threaded openings formed in the plate portion 170 or fixedly connected thereto e.g. by welding, brazing or glueing.

In a still further alternative it is considered to provide the plate portions 170 with a wear resistant rubber coating. The latter may have a profiled surface being similar to the rib structure 180 shown in FIG. 4.

As indicated in FIG. 1, each of the return rollers 72, 74 and 100, 102 comprises two end plates 184 which are interconnected by a shaft 186, the latter also forming the shaft for journaling the return roller.

If a transport element 78 or 104 is used, which comprises plate chain members 168 as shown in FIGS. 3 and 4, the return rollers 72, 74 and 100, 102 must be appropriately shaped. As may be seen from FIG. 5 the end plates 184 are of polygonal contour and at the corners of the polygan there are provided part circular recesses 188, each of which is dimensioned so as to receive one of the hinge ribs 176 under small play. The thus formed end plates 184 are capable of transmitting high forces to the transport elements.

Figure 6:
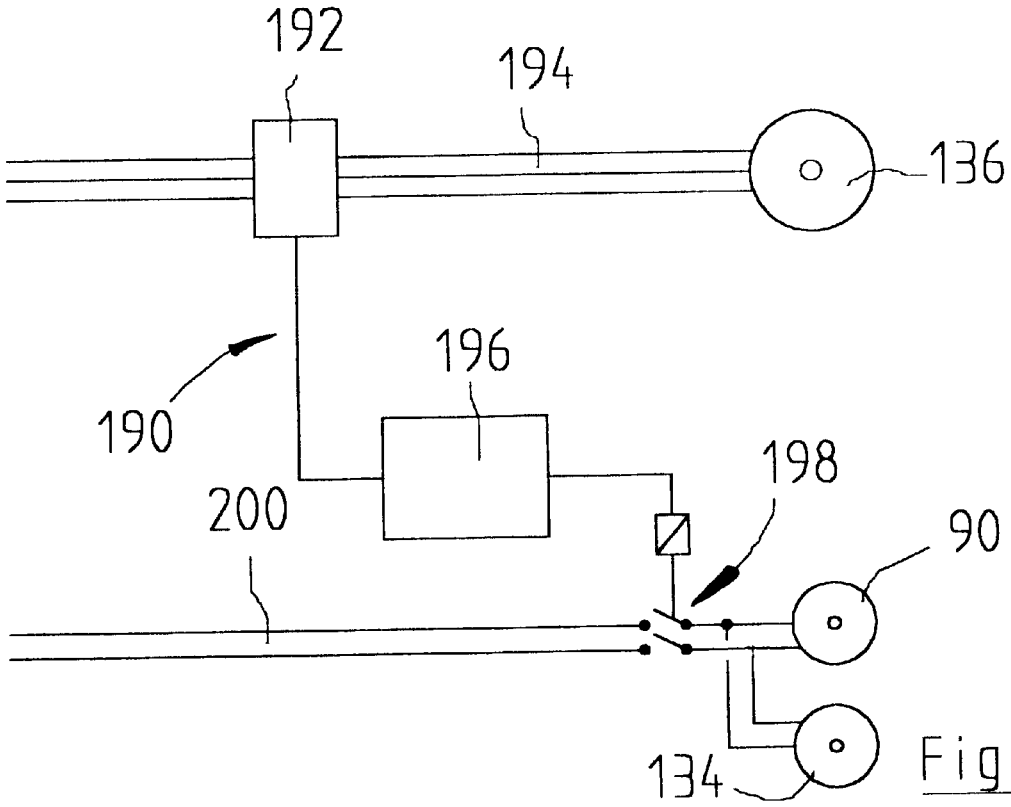
FIG. 6 is a schematic block diagram of a load sensitive control circuit for drive motors of a waste material transport unit of the grinder shown in FIG. 1.

FIG. 6 shows a block diagram of a control circuit 190 which will avoid running of the grinding rotor 24 and its electric drive motor 136 under overload conditions:

The control circuit 190 comprises a power sensor 192 connected into a three phase supply line 194 of the motor 136.

The signal output terminal of the power sensor 192 is connected to the input terminal of a window comparator 196. The latter has a built in hysteresis feature and will supply an output signal "1", if the input signal has had a phase, wherein it was smaller than 60% of the maximum allowable load of the motor 136, and has not exceeded a value corresponding to 80% of the nominal load of the motor 136 thereafter. Contrarily, the window comparator 196 will provide an output signal "0" once the signal output from the power sensor 192 has become greater than a signal corresponding to 80% of the nominal load 136. This output signal "0" will be maintained until the signal output from the power sensor 192 has fallen to a value lower than the output signal corresponding to 60% of the nominal load of the motor 136. At such time a signal "1" will be output.

The signal output from the window comparator 196 is used to control a relay 198 connected into a supply line 200 for the two motors 96 and 134.

What is claimed is:

1. A grinder for comminuting waste material comprising:

a frame structure, comprising a grinder rotor journalled in the frame structure, which includes a plurality of cutting tools, comprising a counter blade carried by the frame structure and cooperating with the grinding rotor, and comprising feed means to positively feed waste material to the grinding rotor, wherein the feed means comprise a lower feed conveyor and an upper feed conveyor which are vertically aligned and each comprise an endless transport element running on two spaced return rollers, a lower work run of the upper conveyor and an upper work run of the lower conveyor thus forming a moving wall feeding passage for the waste material to be comminuted, wherein the endless transport element comprises a plate chain comprising plate chain members each having a plate portion and forward and rear hinge portions such that cooperating hinge portions of adjacent plate chain members form a hinge rib of constant cross section.

2. The grinder in accordance with claim 1, wherein the endless transport element comprises a plate chain.

3. The grinder in accordance with claim 2, wherein the plate chain comprises plate chain members each having a plate portion and forward and rear hinge portions.

4. The grinder in accordance with claim 3, wherein the plate chain member has a high friction surface.

5. The grinder in accordance with claim 4, wherein the high friction surface comprises a rib structure.

6. The grinder in accordance with claim 4, wherein the high friction surface comprises at least one spike.

7. The grinder in accordance with claim 4, wherein the high friction surface comprises a rubber coating.

8. The grinder in accordance with claim 1, wherein the return rollers are provided with recesses cooperating with projections formed on the inward surface of the associated transport element.

9. The grinder in accordance with claim 1, wherein the return rollers are of polygonal cross section.

10. The grinder in accordance with claim 1, wherein the return rollers comprise spaced end plates and a shaft rigidly connecting the end plates.

11. The grinder in accordance with claim 1, characterized in that at least one of the conveyors comprises a subframe movably carried by the frame structure.

12. The grinder in accordance with claim 11, wherein the downstream return roller of one of the conveyors is carried by the movable subframe so as to be adjustable in vertical direction.

13. The grinder in accordance with claim 11, wherein the movable subframe is pivotable about the axis of the upstream return roller of the movable conveyor.

14. The grinder in accordance with claim 11, wherein the subframe cooperates with a vertically adjustable abutment member.

15. The grinder in accordance with claim 1, wherein a support plate to supports the upper run of at least one of the conveyors.

16. The grinder in accordance with claim 15 wherein at least part of the support plate is made from material cooperating with the associated transport element under low friction.

17. The grinder in accordance with claim 1, wherein pressure rollers act on the lower run of the upper conveyor, said pressure rollers being biassed by spring elements.

18. The grinder in accordance with claim 17, wherein at least part of the spring elements comprise gas springs.

19. The grinder in accordance with claim 1, wherein independent identical drive units are provided for the upper and lower conveyors.

20. The grinder in accordance with claim 1, wherein a load sensor cooperates with a motor driving the grinding rotor and drive units associated to the upper and lower conveyors are energized in accordance with the signal output from said load sensor.

21. The grinder in accordance with claim 1, wherein the grinding rotor runs at a speed of 120 to 240 rpm.

22. The grinder in accordance with claim 21, wherein the speed of the grinding rotor is between 160 and 200 rpm.

23. A grinder for comminuting waste material comprising:

a frame structure, comprising a grinder rotor journalled in the frame structure, which includes a plurality of cutting tools, comprising a counter blade carried by the frame structure and cooperating with the grinding rotor, and comprising feed means to positively feed waste material to the grinding rotor, wherein the feed means comprise a lower feed conveyor and an upper feed conveyor which are vertically aligned and each comprise an endless transport element running on two spaced return rollers, a lower work run of the upper conveyor and an upper work run of the lower conveyor thus forming a moving wall feeding passage for the waste material to be comminuted, wherein pressure rollers act on the lower run of the upper conveyor, said press rollers being biased by spring elements.

* * * * *